US007854597B2

(12) United States Patent
Stiles, Jr. et al.

(10) Patent No.: US 7,854,597 B2
(45) Date of Patent: Dec. 21, 2010

(54) PUMPING SYSTEM WITH TWO WAY COMMUNICATION

(75) Inventors: Robert W. Stiles, Jr., Cary, NC (US); Lars Hoffmann Berthelsen, Kolding (DK); Ronald B. Robol, Sanford, NC (US); Christopher R. Yahnker, Raleigh, NC (US); Daniel J. Hruby, Sanford, NC (US); Kevin Murphy, Quartz Hill, CA (US); Edward Brown, Moorpark, CA (US); David MacCallum, Camarillo, CA (US); Dennis Dunn, Moorpark, CA (US); Kenneth N. Clack, Sanford, NC (US); Einar Kjartan Runarsson, Soenderborg (DK); Alberto Morando, Soenderborg (DK)

(73) Assignees: Pentair Water Pool and Spa, Inc., Sanford, NC (US); Danfoss Low Power Drives, Graasten (DK)

( * ) Notice: Subject to any disclaimer, the term of this patent is extended or adjusted under 35 U.S.C. 154(b) by 0 days.

(21) Appl. No.: 11/608,860

(22) Filed: Dec. 11, 2006

(65) Prior Publication Data

US 2007/0154322 A1 Jul. 5, 2007

Related U.S. Application Data

(63) Continuation-in-part of application No. 10/926,513, filed on Aug. 26, 2004, and a continuation-in-part of application No. 11/286,888, filed on Nov. 23, 2005.

(51) Int. Cl.
*F04B 49/06* (2006.01)

(52) U.S. Cl. ..... 417/44.11; 417/44.1; 417/45; 210/167.1; 4/508; 4/509

(58) Field of Classification Search ..... 417/44.1, 417/44.11, 45; 210/167.01, 167.1, 167.14; 4/508, 509

See application file for complete search history.

(56) References Cited

U.S. PATENT DOCUMENTS 3,613,805 A 10/1971 Linstad (Continued)

FOREIGN PATENT DOCUMENTS

DE 19645129 5/1998

(Continued)

OTHER PUBLICATIONS

"Better, Stronger, Faster;" Pool & SPA News, Sep. 3, 2004; pp. 52-54, 82-84, USA.

*Primary Examiner*—Devon C Kramer
*Assistant Examiner*—Leonard J Weinstein
(74) *Attorney, Agent, or Firm*—Greenberg Traurig, LLP

(57) ABSTRACT

A pumping system for moving water of a swimming pool includes a water pump, a variable speed motor, and an arrangement for controlling the variable speed motor. The pumping system further includes an auxiliary device operably connected to the arrangement for controlling, and an arrangement for providing two-way communication between the arrangement for controlling and the auxiliary device. The arrangement for controlling is capable of receiving a parameter from the auxiliary device through the arrangement for providing two-way communication. In one example, the arrangement for controlling is capable of independently controlling the variable speed motor without receipt of a parameter from the auxiliary device. In addition or alternatively, the arrangement for controlling is operable to selectively alter operation of the motor based upon the parameter. In addition or alternatively, the arrangement for controlling is configured to optimize a power consumption of the variable speed motor over time based upon the parameters received. A method for controlling the pumping system is also provided.

34 Claims, 7 Drawing Sheets

U.S. PATENT DOCUMENTS 3,778,804 A * 12/1973 Adair ..... 340/544
3,787,882 A 1/1974 Fillmore
4,353,220 A 10/1982 Curwen
4,494,180 A 1/1985 Streater
4,610,605 A 9/1986 Hartley
4,678,409 A 7/1987 Kurokawa
4,703,387 A 10/1987 Miller
4,767,280 A 8/1988 Markuson
4,795,314 A 1/1989 Prybella
4,834,624 A 5/1989 Jensen
4,912,936 A 4/1990 Denpou
4,963,778 A 10/1990 Jensen
5,026,256 A 6/1991 Kuwabara
5,099,181 A 3/1992 Canon
5,117,233 A * 5/1992 Hamos et al. ..... 340/825.69
5,123,080 A 6/1992 Gillett
5,156,535 A 10/1992 Burdis
5,158,436 A 10/1992 Jensen
5,167,041 A 12/1992 Burkitt
5,240,380 A 8/1993 Mabe
5,342,176 A 8/1994 Redlich
5,471,125 A 11/1995 Wu
5,512,883 A 4/1996 Lane
5,518,371 A 5/1996 Wellstein
5,519,848 A 5/1996 Wloka
5,520,517 A 5/1996 Sipin
5,571,000 A 11/1996 Zimmermann
5,580,221 A 12/1996 Triezenberg
5,598,080 A 1/1997 Jensen
5,614,812 A 3/1997 Wagoner
5,626,464 A 5/1997 Schoenmyr
5,628,896 A 5/1997 Klingenberger
5,711,483 A 1/1998 Hays
5,727,933 A 3/1998 Laskaris et al.
5,791,882 A 8/1998 Stucker
5,804,080 A 9/1998 Klingenberger
5,819,848 A 10/1998 Rasmusson
5,883,489 A 3/1999 Konrad
5,909,372 A 6/1999 Thybo
5,941,690 A 8/1999 Lin
5,969,958 A 10/1999 Nielsen
5,973,465 A 10/1999 Rayner
6,037,742 A 3/2000 Rasmussen
6,046,492 A 4/2000 Machida
6,048,183 A 4/2000 Meza
6,072,291 A 6/2000 Pedersen
6,091,604 A 7/2000 Plougsgaard
6,102,665 A 8/2000 Centers
6,125,481 A 10/2000 Sicilano
6,142,741 A 11/2000 Nishihata
6,208,112 B1 3/2001 Jensen
6,254,353 B1 7/2001 Polo
6,264,431 B1 7/2001 Triezenberg
6,299,414 B1 10/2001 Schoenmyr
6,326,752 B1 12/2001 Jensen
6,351,359 B1 2/2002 Jaeger
6,354,805 B1 3/2002 Moller
6,373,728 B1 4/2002 Aarestrup
6,380,707 B1 4/2002 Rosholm
6,406,265 B1 6/2002 Hahn
6,416,295 B1 7/2002 Nagai
6,426,633 B1 7/2002 Thybo
6,450,771 B1 9/2002 Centers
6,464,464 B2 10/2002 Sabini
6,468,042 B2 10/2002 Moller
6,468,052 B2 10/2002 McKain et al.
6,474,949 B1 11/2002 Arai
6,481,973 B1 11/2002 Struthers
6,483,378 B2 11/2002 Blodgett
6,548,976 B2 4/2003 Jensen
6,623,245 B2 9/2003 Meza
6,676,831 B2 * 1/2004 Wolfe ..... 210/85
6,690,250 B2 2/2004 Moller
6,715,996 B2 4/2004 Moeller
6,717,318 B1 4/2004 Mathiassen
6,747,367 B2 * 6/2004 Cline et al. ..... 307/11
6,774,664 B2 8/2004 Godbersen
6,925,823 B2 8/2005 Lifson
7,005,818 B2 2/2006 Jensen
7,050,278 B2 5/2006 Poulsen
7,083,392 B2 8/2006 Meza
7,221,121 B2 5/2007 Skaug
2001/0041139 A1 11/2001 Sabini et al.
2002/0050490 A1 * 5/2002 Pittman et al. ..... 219/481
2002/0070875 A1 * 6/2002 Crumb ..... 340/825.69
2002/0136642 A1 9/2002 Moller
2003/0017055 A1 * 1/2003 Fong ..... 417/44.9
2003/0099548 A1 5/2003 Meza
2003/0196942 A1 * 10/2003 Jones ..... 210/169
2004/0009075 A1 1/2004 Meza
2004/0013531 A1 1/2004 Curry et al.
2005/0123408 A1 * 6/2005 Koehl ..... 417/53
2005/0190094 A1 9/2005 Andersen
2005/0226731 A1 10/2005 Mehlhorn
2006/0045750 A1 3/2006 Stiles
2006/0090255 A1 5/2006 Cohen
2006/0127227 A1 6/2006 Mehlhorn
2007/0114162 A1 5/2007 Stiles
2007/0154319 A1 7/2007 Stiles
2007/0154320 A1 7/2007 Stiles
2007/0154321 A1 7/2007 Stiles
2007/0154323 A1 7/2007 Stiles
2007/0163929 A1 7/2007 Stiles
2007/0183902 A1 8/2007 Stiles

FOREIGN PATENT DOCUMENTS

DE 10231773 2/2004
DE 19938490 4/2005
EP 0314249 5/1989
EP 0709575 5/1996
EP 0735273 10/1996
EP 0978657 2/2000
FR 2529965 6/1983
FR 2703409 10/1994
JP 5010270 1/1993
WO WO 98/04835 2/1998
WO WO 01/47099 6/2001
WO WO 2004/006416 1/2004
WO WO 2004/088694 10/2004
WO WO 2006/069568 7/2006

* cited by examiner

PUMPING SYSTEM WITH TWO WAY COMMUNICATION

RELATED APPLICATIONS

This application is a continuation-in-part application of U.S. application Ser. No. 10/926,513, filed Aug. 26, 2004, and U.S. application Ser. No. 11/286,888, filed Nov. 23, 2005, the entire disclosures of which are hereby incorporated herein by reference.

FIELD OF THE INVENTION

The present invention relates generally to control of a pump, and more particularly to control of a variable speed pumping system for a pool.

BACKGROUND OF THE INVENTION

Conventionally, a pump to be used in a pool is operable at a finite number of predetermined speed settings (e.g., typically high and low settings). Typically these speed settings correspond to the range of pumping demands of the pool at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pool conditions and/or pumping demands.

Conventionally, it is also typical to equip a pumping system for use in a pool with auxiliary devices, such as a heating device, a chemical dispersion device (e.g., a chlorinator or the like), a filter arrangement, and/or an automation device. Often, operation of a particular auxiliary device can require different pump performance characteristics. For example, operation of a heating device may require a specific water flow rate or flow pressure for correct heating of the pool water. It is possible that a conventional pump can be manually adjusted to operate at one of a finite number of speed settings in response to a water demand from an auxiliary device. However, adjusting the pump to one of the settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired.

Thus, operation of the pump at particular performance characteristics could optimize energy consumption. For example, two-way communication between the pool pump and various auxiliary devices could to permit the pump to alter operation in response to the various performance characteristics required by the various auxiliary devices. Therefore, by allowing the pool pump to communication with the various auxiliary devices, the pump could satisfy the demand for water while optimizing the overall system energy consumption.

Accordingly, it would be beneficial to provide a pump that could be readily and easily adapted to communicate with various auxiliary devices to provide a suitably supply of water at a desired pressure to pools having a variety of sizes and features. Further, the pump should be responsive to a change of conditions (i.e., a clogged filter or the like), user input instructions, and/or communication with the auxiliary devices.

SUMMARY OF THE INVENTION

In accordance with one aspect, the present invention provides a pumping system for moving water of a swimming pool. The pumping system includes a water pump for moving water in connection with performance of an operation upon the water, a variable speed motor operatively connected to drive the pump, and means for controlling the variable speed motor. The pumping system further includes an auxiliary device operably connected to the means for controlling, and means for providing two-way communication between the means for controlling and the auxiliary device. The means for controlling is capable of receiving a parameter from the auxiliary device through the means for providing two-way communication, and is capable of independently controlling the variable speed motor without receipt of a parameter from the auxiliary device.

In accordance with another aspect, the present invention provides a pumping system for moving water of a swimming pool. The pumping system includes a water pump for moving water in connection with performance of an operation upon the water, a variable speed motor operatively connected to drive the pump, and means for controlling the variable speed motor. The pumping system further includes an auxiliary device operably connected to the means for controlling, and means for providing two-way communication between the means for controlling and the auxiliary device. The means for controlling is capable of receiving a parameter from the auxiliary device through the means for providing two-way communication, and is operable to selectively alter operation of the motor based upon the parameter.

In accordance with another aspect, the present invention provides a pumping system for moving water of a swimming pool. The pumping system includes a water pump for moving water in connection with performance of an operation upon the water, a variable speed motor operatively connected to drive the pump, and means for controlling the variable speed motor. The pumping system further includes a plurality of auxiliary devices operably connected to the means for controlling, and means for providing two-way communication between the means for controlling and the auxiliary devices. The means for controlling is capable of receiving a plurality of parameters from the auxiliary devices through the means for providing two-way communication, and is configured to optimize a power consumption of the variable speed motor over time based upon the parameters received from the auxiliary devices.

In accordance with yet another aspect, the present invention provides a method of controlling a pumping system for moving water of a swimming pool is provided. The pumping system includes a water pump for moving water in connection with performance of an operation upon the water and a variable speed motor operatively connected to drive the pump. The method comprises the steps of providing means for controlling the variable speed motor, providing an auxiliary device operably connected to the means for controlling, and providing two-way communication between the means for controlling and the auxiliary device. The method also includes the steps of receiving a parameter to the means for controlling from the auxiliary device through the two-way communication, and selectively altering operation of the motor based upon the parameter.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
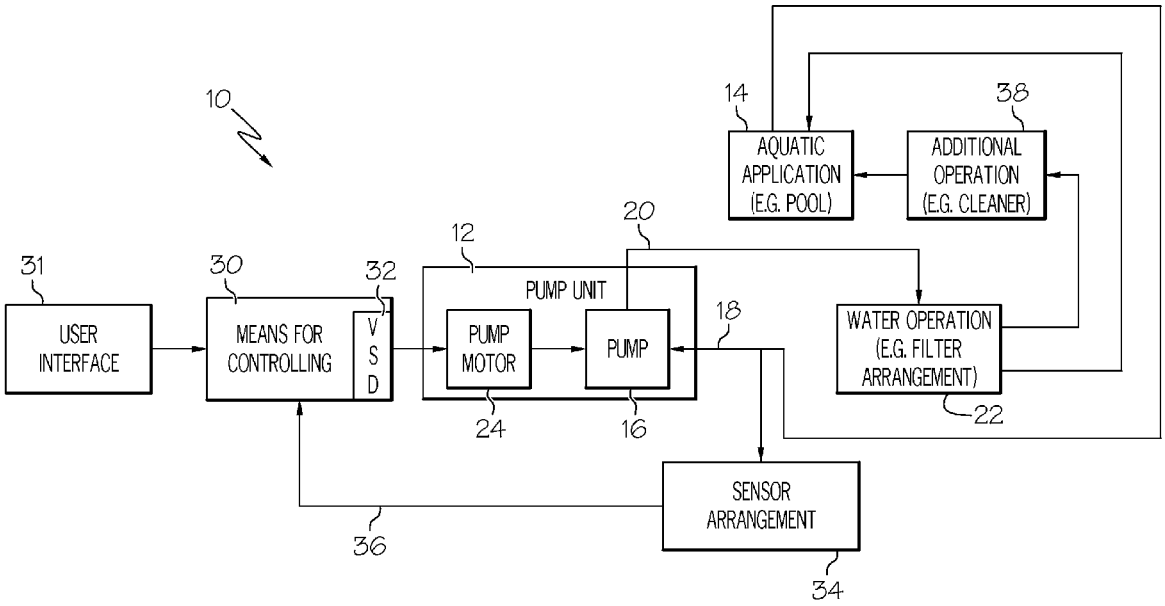
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with one aspect of the present invention is schematically shown in FIG. 1. The pumping system 10 includes a pump unit 12 that is shown as being used with a pool 14. It is to be appreciated that the pump unit 12 includes a pump 16 for moving water through inlet and outlet lines 18 and 20.

The swimming pool 14 is one example of a pool. The definition of "swimming pool" includes, but is not limited to, swimming pools, spas, and whirlpool baths, and further includes features and accessories associated therewith, such as water jets, waterfalls, fountains, pool filtration equipment, chemical treatment equipment, pool vacuums, spillways and the like.

A water operation 22 is performed upon the water moved by the pump 16. Within the shown example, water operation 22 is a filter arrangement that is associated with the pumping system 10 and the pool 14 for providing a cleaning operation (i.e., filtering) on the water within the pool. The filter arrangement 22 is operatively connected between the pool 14 and the pump 16 at/along an inlet line 18 for the pump. Thus, the pump 16, the pool 14, the filter arrangement 22, and the interconnecting lines 18 and 20 form a fluid circuit or pathway for the movement of water.

It is to be appreciated that the function of filtering is but one example of an operation that can be performed upon the water. Other operations that can be performed upon the water may be simplistic, complex or diverse. For example, the operation performed on the water may merely be just movement of the water by the pumping system (e.g., re-circulation of the water in a waterfall or spa environment).

Turning to the filter arrangement 22, any suitable construction and configuration of the filter arrangement is possible. For example, the filter arrangement 22 can include a sand filter, a cartridge filter, and/or a diatomaceous earth filter, or the like. In another example, the filter arrangement 22 may include a skimmer assembly for collecting coarse debris from water being withdrawn from the pool, and one or more filter components for straining finer material from the water. In still yet another example, the filter arrangement 22 can be in fluid communication with a pool cleaner, such as a vacuum pool cleaner adapted to vacuum debris from the various submerged surfaces of the pool. The pool cleaner can include various types, such as various manual and/or automatic types.

The pump 16 may have any suitable construction and/or configuration for providing the desired force to the water and move the water. In one example, the pump 16 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. Although centrifugal pumps are well suited to pump a large volume of water at a continuous rate, other motor-operated pumps may also be used within the scope of the present invention.

Drive force is provided to the pump 16 via a pump motor 24. In the one example, the drive force is in the form of rotational force provided to rotate the impeller of the pump 16. In one specific embodiment, the pump motor 24 is a permanent magnet motor. In another specific embodiment, the pump motor 24 is an induction motor. In yet another embodiment, the pump motor 24 can be a synchronous or asynchronous motor. The pump motor 24 operation is infinitely variable within a range of operation (i.e., zero to maximum operation). In one specific example, the operation is indicated by the RPM of the rotational force provided to rotate the impeller of the pump 16. In the case of a synchronous motor 24, the steady state speed (RPM) of the motor 24 can be referred to as the synchronous speed. Further, in the case of a synchronous motor 24, the steady state speed of the motor 24 can also be determined based upon the operating frequency in hertz (Hz).

A means for controlling 30 provides for the control of the pump motor 24 and thus the control of the pump 16. Within the shown example, the means for controlling 30 can include a variable speed drive 32 that provides for the infinitely variable control of the pump motor 24 (i.e., varies the speed of the pump motor). By way of example, within the operation of the variable speed drive 32, a single phase AC current from a source power supply is converted (e.g., broken) into a three-phase AC current. Any suitable technique and associated construction/configuration may be used to provide the three-phase AC current. The variable speed drive supplies the AC electric power at a changeable frequency to the pump motor to drive the pump motor. The construction and/or configuration of the pump 16, the pump motor 24, the means for controlling 30 as a whole, and the variable speed drive 32 as a portion of the means for controlling 30, 130 are not limitations on the present invention. In one possibility, the pump 16 and the pump motor 24 are disposed within a single housing to form a single unit, and the means for controlling 30 with the variable speed drive 32 are disposed within another single housing to form another single unit. In another possibility, these components are disposed within a single housing to form a single unit.

Figure 5:
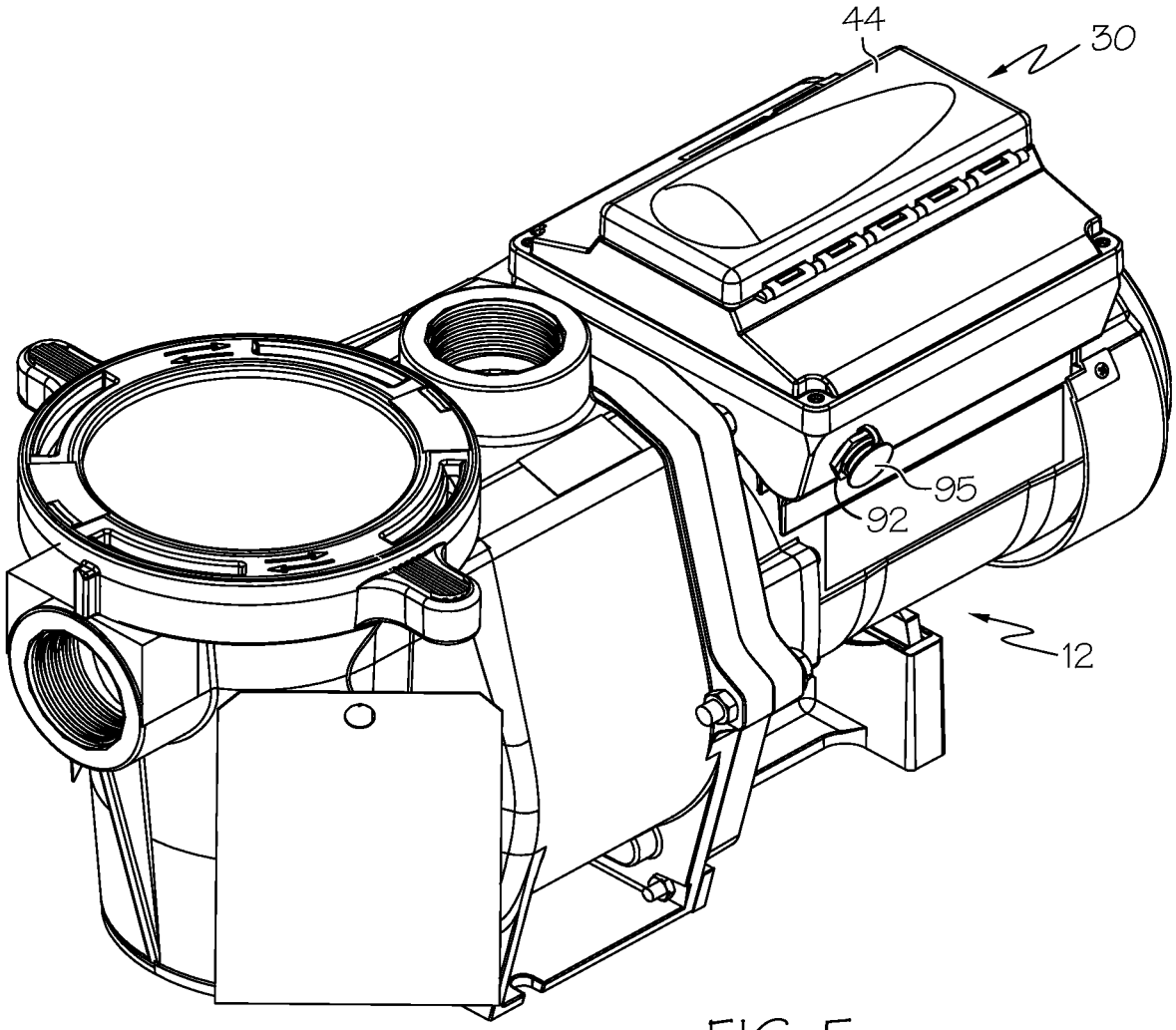
FIG. 5 is a perceptive view of an example pump unit that incorporates the present invention.

Further still, the means for controlling 30 can receive input from a user interface 31 that can be operatively connected to the means for controlling 30 in various manners. For example, the user interface 31 can include a keypad 40, buttons, switches, or the like such that a user could input various parameters into the means for controlling 30. In addition or alternatively, the user interface 31 can be adapted to provide visual and/or audible information to a user. For example, the user interface 31 can include one or more visual displays 42, such as an alphanumeric LCD display, LED lights, or the like. Additionally, the user interface 31 can also include a buzzer, loudspeaker, or the like. Further still, as shown in FIG. 5, the user interface 31 can include a removable (e.g., pivotable, slidable, detachable, etc.) protective cover 44 adapted to provide protection against damage when the user interface 31 is not in use. The protective cover 44 can include various rigid or semi-rigid materials, such as plastic, and can have various degrees of light permeability, such as opaque, translucent, and/or transparent.

The pumping system 10 can have additional means used for control of the operation of the pump. In accordance with one aspect of the present invention, the pumping system 10 includes means for sensing, determining, or the like one or more parameters indicative of the operation performed upon the water. Within one specific example, the system includes means for sensing, determining or the like one or more parameters indicative of the movement of water within the fluid circuit.

The ability to sense, determine or the like one or more parameters may take a variety of forms. For example, one or more sensors 34 may be utilized. Such one or more sensors 34 can be referred to as a sensor arrangement. The sensor arrangement 34 of the pumping system 10 would sense one or more parameters indicative of the operation performed upon the water. Within one specific example, the sensor arrangement 34 senses parameters indicative of the movement of water within the fluid circuit. The movement along the fluid circuit includes movement of water through the filter arrangement 22. As such, the sensor arrangement 34 includes at least one sensor used to determine flow rate of the water moving within the fluid circuit and/or includes at least one sensor used to determine flow pressure of the water moving within the fluid circuit. In one example, the sensor arrangement 34 is operatively connected with the water circuit at/adjacent to the location of the filter arrangement 22. It should be appreciated that the sensors of the sensor arrangement 34 may be at different locations than the locations presented for the example. Also, the sensors of the sensor arrangement 34 may be at different locations from each other. Still further, the sensors may be configured such that different sensor portions are at different locations within the fluid circuit. Such a sensor arrangement 34 would be operatively connected 36 to the means for controlling 30 to provide the sensory information thereto.

It is to be noted that the sensor arrangement 34 may accomplish the sensing task via various methodologies, and/or different and/or additional sensors may be provided within the system 10 and information provided therefrom may be utilized within the system. For example, the sensor arrangement 34 may be provided that is associated with the filter arrangement and that senses an operation characteristic associated with the filter arrangement. For example, such a sensor may monitor filter performance. Such monitoring may be as basic as monitoring filter flow rate, filter pressure, or some other parameter that indicates performance of the filter arrangement. Of course, it is to be appreciated that the sensed parameter of operation may be otherwise associated with the operation performed upon the water. As such, the sensed parameter of operation can be as simplistic as a flow indicative parameter such as rate, pressure, etc.

Such indication information can be used by the means for controlling 30 via performance of a program, algorithm or the like, to perform various functions, and examples of such are set forth below. Also, it is to be appreciated that additional functions and features may be separate or combined, and that sensor information may be obtained by one or more sensors. With regard to the specific example of monitoring flow rate and flow pressure, the information from the sensor arrangement 34 can be used as an indication of impediment or hindrance via obstruction or condition, whether physical, chemical, or mechanical in nature, that interferes with the flow of water from the pool to the pump such as debris accumulation or the lack of accumulation, within the filter arrangement 34.

Figure 2:
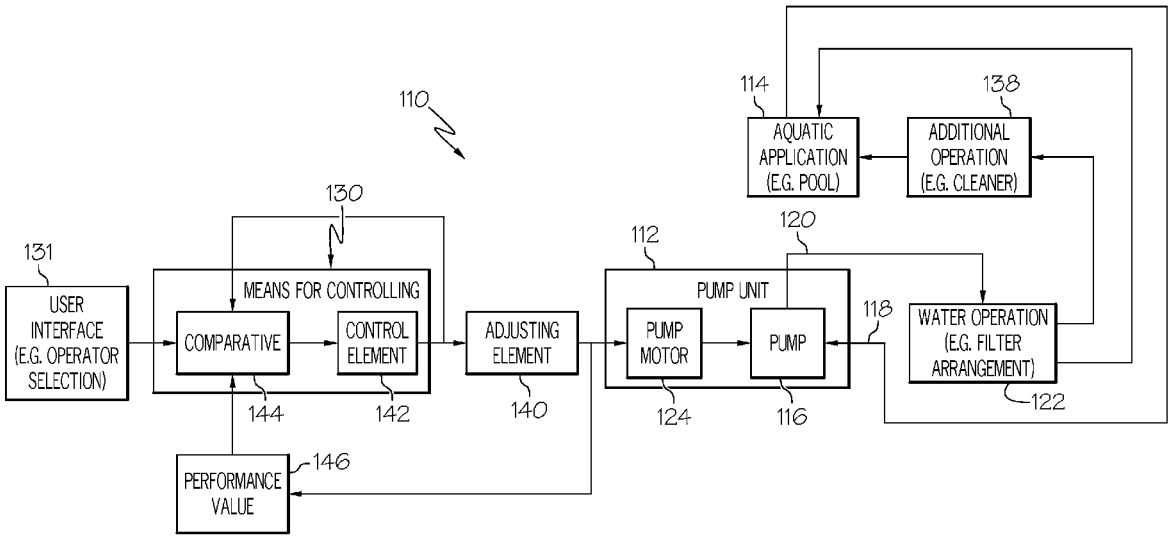
FIG. 2 is another block diagram of another example of a variable speed pumping system in accordance with the present invention with a pool environment.

The example of FIG. 1 shows an example additional operation 38 and the example of FIG. 2 shows an example additional operation 138. Such an additional operation (e.g., 38 or 138) may be a cleaner device, either manual or autonomous. As can be appreciated, an additional operation involves additional water movement. Also, within the presented examples of FIGS. 1 and 2, the water movement is through the filter arrangement (e.g., 22 or 122). Such, additional water movement may be used to supplant the need for other water movement, as will be discussed further herein.

Within another example (FIG. 2) of a pumping system 110 that includes means for sensing, determining, or the like one or more parameters indicative of the operation performed upon the water, and the means for controlling 130 can determine the one or more parameters via sensing, determining or the like parameters associated with the operation of a pump 116 of a pump unit 112. Such an approach is based upon an understanding that the pump operation itself has one or more relationships to the operation performed upon the water.

It should be appreciated that the pump unit 112, which includes the pump 116 and a pump motor 124, a pool 114, a filter arrangement 122, and interconnecting lines 118 and 120, may be identical or different from the corresponding items within the example of FIG. 1. In addition, as stated above, the means for controlling 130 can receive input from a user interface 131 that can be operatively connected to the controller in various manners.

Keeping with the example of FIG. 2, some examples of the pumping system 110, and specifically the means for controlling 30, 130 and associated portions, that utilize at least one relationship between the pump operation and the operation performed upon the water attention are shown in U.S. Pat. No. 6,354,805, to Moller, entitled "Method For Regulating A Delivery Variable Of A Pump" and U.S. Pat. No. 6,468,042, to Moller, entitled "Method For Regulating A Delivery Variable Of A Pump." The disclosures of these patents are incorporated herein by reference. In short summary, direct sensing of the pressure and/or flow rate of the water is not performed, but instead one or more sensed or determined parameters associated with pump operation are utilized as an indication of pump performance. One example of such a pump parameter is input power. Pressure and/or flow rate can be calculated/determined from such pump parameter(s).

Although the system 110 and the means for controlling 30, 130 there may be of varied construction, configuration and operation, the function block diagram of FIG. 2 is generally representative. Within the shown example, an adjusting element 140 is operatively connected to the pump motor and is also operatively connected to a control element 142 within the controller 130. The control element 142 can operate in response to a comparative function 144, which receives input from a power calculation 146.

The power calculation 146 is performed utilizing information from the operation of the pump motor 124 and controlled by the adjusting element 140. As such, a feedback iteration is performed to control the pump motor 124. Also, it is the operation of the pump motor and the pump that provides the information used to control the pump motor/pump. As mentioned, it is an understanding that operation of the pump motor/pump has a relationship to the flow rate and/or pressure of the water flow that is utilized to control flow rate and/or flow pressure via control of the pump.

As mentioned, the sensed, determined (e.g., calculated, provided via a look-up table, graph or curve, such as a constant flow curve or the like, etc.) information can be utilized to determine the various performance characteristics of the pumping system 110, such as input power consumed, motor speed, flow rate and/or the flow pressure. In one example, the operation can be configured to prevent damage to a user or to the pumping system 10, 110 caused by an obstruction. Thus, the means for controlling (e.g., 30 or 130) provides the control to operate the pump motor/pump accordingly. In other words, the means for controlling (e.g., 30 or 130) can repeatedly monitor one or more performance value(s) 146 of the pumping system 10,110, such as the input power consumed by, or the speed of, the pump motor (e.g., 24 or 124) to sense or determine a parameter indicative of an obstruction or the like.

Figure 3:
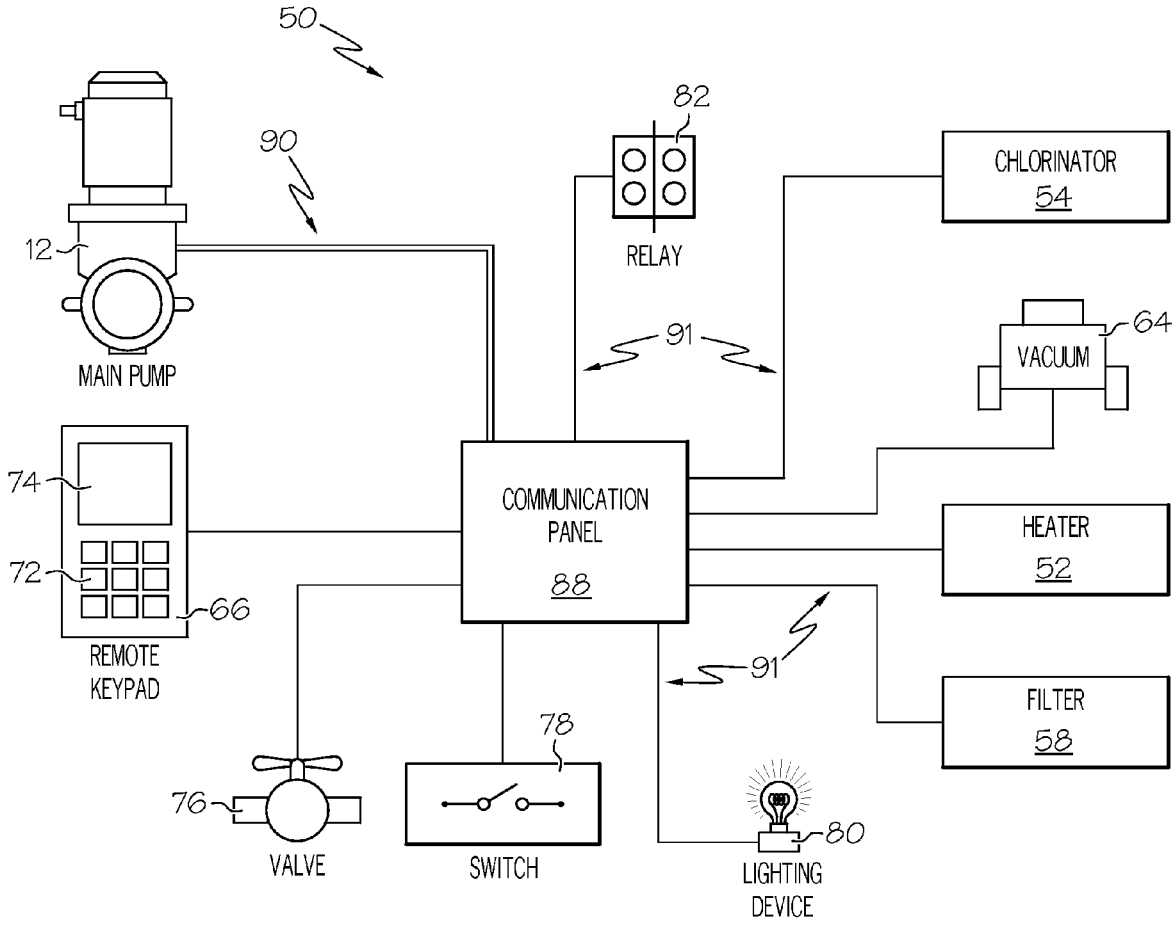
FIG. 3 is a schematic illustration of example auxiliary devices that can be operably connected to an example means for controlling the motor.
Figure 4:
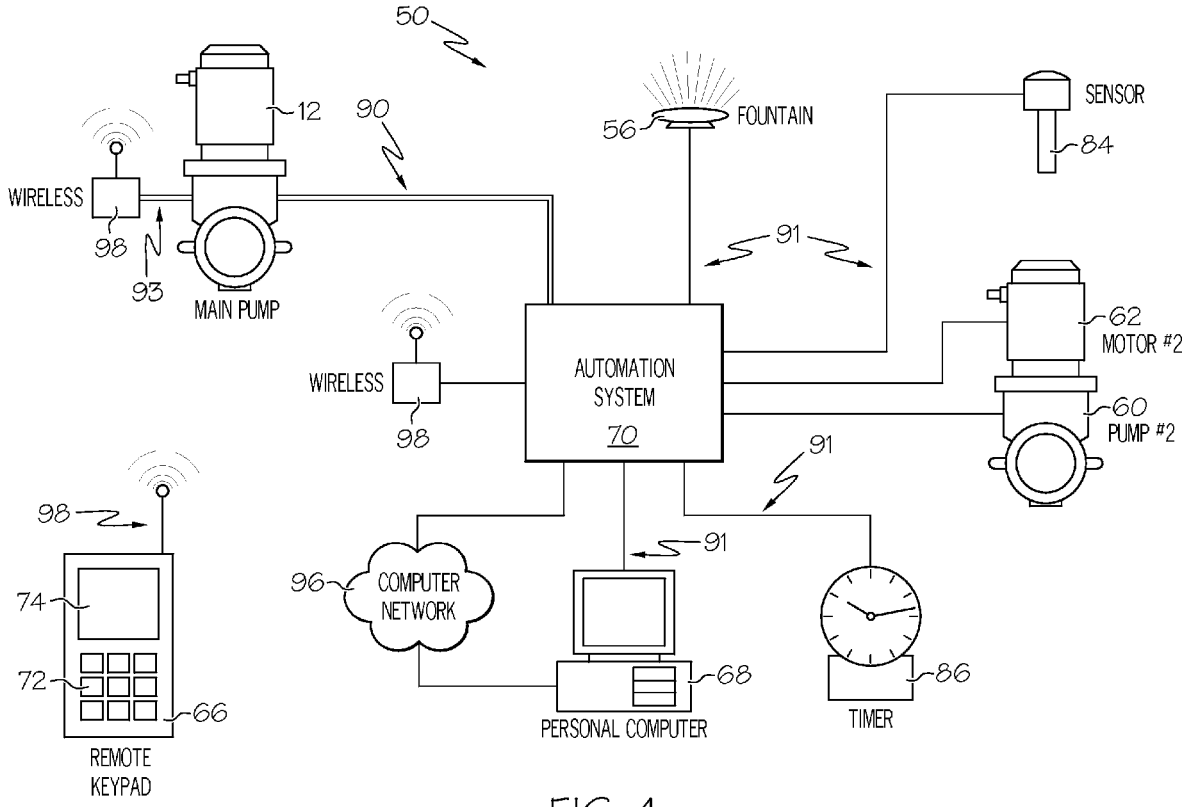
FIG. 4 is similar to FIG. 3, but shows various other example auxiliary devices.

Turning now to FIGS. 3-4, in accordance with an aspect of the present invention, the pumping system 10, 110 can include one or more auxiliary devices 50 operably connected to the means for controlling 30, 130. As shown in FIGS. 3-4, the auxiliary devices 50 can include various devices, including mechanical, electrical, and/or chemical devices, that can be connected to the means for controlling 30, 130 in various mechanical and/or electrical manners. In one example, the auxiliary devices 50 can include devices configured to perform an operation upon the water moved by the water pump 12, 112. Various examples can include a water heating device 52, a chemical dispersion device 54 for dispersing chemicals into the water, such as chlorine, bromine, ozone, etc., and/or a water dispersion device 56, such as a water fountain or water jet. Further examples can include a filter arrangement 58 for performing a filtering operation upon the water, a second water pump 60 with a second pump motor 62 for moving the water, and/or a vacuum 64 device, such as a manual or automatic vacuum device for cleaning the swimming pool.

In another example, the auxiliary devices 50 can include a user interface device capable of receiving information input by a user, such as a parameter related to operation of the pumping system 10, 110. Various examples can include a remote keypad 66, such as a remote keypad similar to the keypad 40 and display 42 of the means for controlling 30, a personal computer 68, such as a desktop computer, a laptop, a personal digital assistant, or the like, and/or an automation control system 70, such as various analog or digital control systems that can include programmable logic controllers (PLC), computer programs, or the like. The various user interface devices 66, 68, 70, as illustrated by the remote keypad 66, can include a keypad 72, buttons, switches, or the like such that a user could input various parameters and information. In addition or alternatively, the user interface devices 66, 68, 70 can be adapted to provide visual and/or audible information to a user, and can include one or more visual displays 74, such as an alphanumeric LCD display, LED lights, or the like, and/or a buzzer, loudspeaker, or the like (not shown). Thus, for example, a user could use a remote keypad 66 or automation system 70 to monitor the operational status of the pumping system 10, 110.

In still yet another example, the auxiliary devices 50 can include various miscellaneous devices for interaction with the swimming pool. Various examples can include a valve 76, such as a mechanically or electrically operated water valve, an electrical switch 78, a lighting device 80 for providing illumination to the swimming pool and/or associated devices, an electrical or mechanical relay 82, a sensor 84, including but not limited to those sensors 34 discussed previously herein, and/or a mechanical or electrical timing device 86. In addition or alternatively, the auxiliary device 50 can include a communication panel 88, such as a junction box, switchboard, or the like, configured to facilitate communication between the means for controlling 30, 130 and various other auxiliary devices 50. The various miscellaneous devices can have direct or indirect interaction with the water of the swimming pool and/or any of the various other devices discussed herein. It is to be appreciated that the various examples discussed herein and shown in the figures are not intended to provide a limitation upon the present invention, and that various other auxiliary devices 50 can be used.

The pumping system 10, 110 can also include means for providing two-way communication between the means for controlling 30, 130 and the one or more auxiliary devices 50. The means for providing two-way communication can include various communication methods configured to permit information, data, commands, or the like to be input, output, processed, transmitted, received, stored, and/or displayed in a two-way exchange between the means for controlling 30, 130 and the auxiliary devices 50. It is to be appreciated that the means for providing two-way communication can provide for control of the pumping system 10, 110, or can also be used to provide information for monitoring the operational status of the pumping system 10, 110.

The various communication methods can include half-duplex communication to provide communication in both directions, but only in one direction at a time (e.g., not simultaneously), or conversely, can include full duplex communication to provide simultaneous two-way communication. Further, the means for providing two-way communication can be configured to provide analog communication, such as through a continuous spectrum of information, or it can also be configured to provide digital communication, such as through discrete units of data, such as discrete signals, numbers, binary numbers, non-numeric symbols, letters, icons, or the like.

In various digital communication schemes, the means for providing two-way communication can be configured to provide communication through various digital communication methods. In one example, the means for providing two-way communication can be configured to provide digital serial communication. As such, the serial communication method can be configured to send and receive data one unit at a time in a sequential manner. Various digital serial communication specifications can be used, such as RS-232 and/or RS-485, both of which are known in the art. The RS-485 specification, for example, can include a two-wire, half-duplex, multipoint serial communication protocol that employs a specified differential form of signaling to transmit information. In addition or alternatively, the digital serial communication can be used in a master/slave configuration, as is know in the art. Various other digital communication methods can also be used, such as parallel communications (e.g., all the data units are sent together), or the like. It is to be appreciated that, despite the particular method used, the means for providing two-way communication can be configured to permit any of the various connected devices to transmit and/or receive information.

The various communication methods can be implemented in various manners, including customized cabling or conventional cabling, including serial or parallel cabling. In addition or alternatively, the communication methods can be implemented through more sophisticated cabling and/or wireless schemes, such as over phone lines, universal serial bus (USB), firewire (IEEE 1394), ethernet (IEEE 802.03), wireless ethernet (IEEE 802.11), bluetooth (IEEE 802.15), WiMax (IEEE 802.16), or the like. The means for providing two-way communication can also include various hardware and/or software converters, translators, or the like configured to provide compatibility between any of the various communication methods.

Further still, the various digital communication methods can employ various protocols including various rules for data representation, signaling, authentication, and error detection to facilitate the transmission and reception of information over the communications method. The communication protocols for digital communication can include various features intended to provide a reliable exchange of data or information over an imperfect communication method. In the example of RS-485 digital serial communication, an example communication protocol can include data separated into categories, such as device address data, preamble data, header data, a data field, and checksum data.

Figure 7:
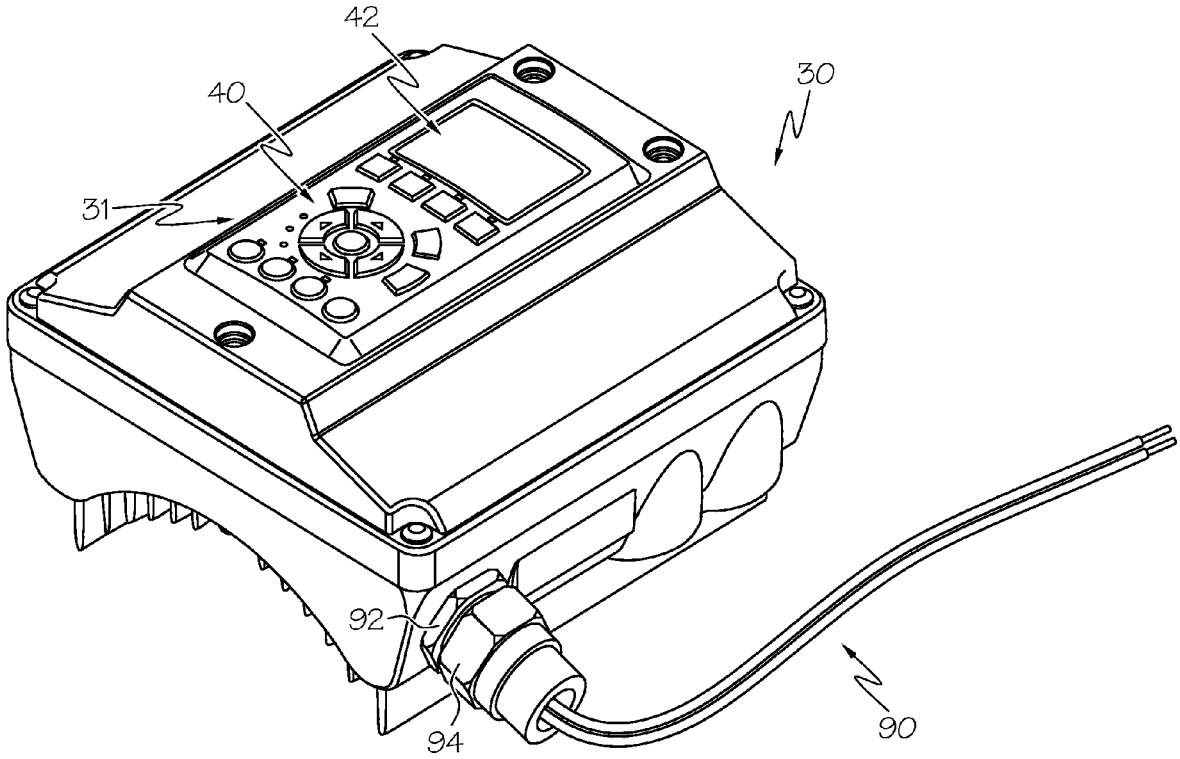
FIG. 7 is a perspective view of an example means for controlling the pump unit shown in FIG. 5.

The means for providing two-way communication can be configured to provide either, or both, of wired or wireless communication. In the example of RS-485 digital serial communication having a two-wire differential signaling scheme, a data cable 90 can include merely two wires, one carrying an electrically positive data signal and the other carrying an electrically negative data signal, though various other wires can also be included to carry various other digital signals. As shown in FIGS. 5 and 7, the means for controlling 30, 130 can include a data port 92 for connection to a data cable connector 94 of the data cable 90. The data cable 90 can include a conventional metal wire cable, though it could also include various other materials, such as a fiber optic cable. The data cable 90 can be shielded to protect from external electrical interferences, and the data cable connector 94 can include various elements to protect against water and corrosion, such as a water resistant, twist lock connector. The data port 92 can even include a protective cover 95 or the like for use when the data cable 90 is disconnected. Further still, the various auxiliary devices 50 can be operably connected to the means for controlling 30, 130 directly or indirectly through various data cables 91.

In addition or alternatively, the means for providing two-way communication can be configured to provide analog and/or digital wireless communication between the means for controlling 30 and the auxiliary devices 50. For example, the means for controlling 30, 130 and/or the auxiliary devices can include a wireless device 98, such as a wireless transmitter, receiver, or transceiver operating on various frequencies, such as radio waves (including cellular phone frequencies), microwaves, or the like. In addition or alternatively, the wireless device 98 can operate on various visible and invisible light frequencies, such as infrared light. As shown in FIG. 4, the wireless device 98 can be built in, or provided as a separate unit connected by way of a data cable 93 or the like.

In yet another example, at least a portion of the means for providing two-way communication can include a computer network 96. The computer network 96 can include various types, such as a local area network (e.g., a network generally covering to a relatively small geographical location, such as a house, business, or collection of buildings), a wide area network (e.g., a network generally covering a relatively wide geographical area and often involving a relatively large array of computers), or even the internet (e.g., a worldwide, public and/or private network of interconnected computer networks, including the world wide web). The computer network 96 can be wired or wireless, as previously discussed herein. The computer network 96 can act as an intermediary between one or more auxiliary devices 50, such as a personal computer 68 or the like, and the means for controlling 30, 130. Thus, a user using a personal computer 68 could exchange data and information with the means for controlling 30, 130 in a remote fashion as per the boundaries of the network 96. In one example, a user using a personal computer 68 connected to the internet could exchange data and information (e.g., for control and/or monitoring) with the means for controlling 30, 130, from home, work, or even another country. In addition or alternatively, a user could exchange data and information for control and/or monitoring over a cellular phone or other personal communication device.

In addition or alternatively, where at least a portion of the means for providing two-way communication includes a computer network 96, various components of the pumping system 10, 110 can be serviced and/or repaired from a remote location. For example, if the pump 12, 112 or means for controlling 30, 130 develops a problem, an end user can contact a service provider (e.g., product manufacturer or authorized service center, etc.) that can remotely access the problematic component through the means for providing two-way communication and the computer network 96 (e.g., the internet). Alternatively, the pumping system 10, 110 can be configured to automatically call out to the service provider when a problem is detected. The service provider can exchange data and information with the problematic component, and can service, repair, update, etc. the component without having a dedicated service person physically present in front of the swimming pool. Thus, the service provider can be located at a central location, and can provide service to any connected pumping system 10, 110, even from around the world. In another example, the service provider can constantly monitor the status (e.g., performance, settings, health, etc.) of the pumping system 10, 110, and can provide various services, as required.

As stated previously herein, the means for controlling 30, 130 can be adapted to control operation of the pump 12, 112 and/or the variable speed motor 24, 124. The means for controlling 30, 130 can alter operation of the variable speed motor 24, 124 based upon various parameters of the pumping system 10, 110, such as water flow rate, water pressure, motor speed, power consumption, filter loading, chemical levels, water temperature, alarms, operational states, or some other parameter that indicates performance of the pumping system 10, 110. It is to be appreciated that the sensed parameter of operation may be otherwise associated with the operation performed upon the water, and/or can even be independent of an operation performed upon the water. As such, the sensed parameter of operation can be as simplistic as a flow indicative parameter such as rate, pressure, etc., or it can involve independent parameters such as time, energy cost, turnovers per day, relay or switch positions, etc. The parameters can be received by the means for controlling 30, 130 in various manners, such as through the previously discussed sensor arrangements 34, user interfaces 31, 131 and/or the means for providing two-way communication.

Regardless of the methodology used, the means for controlling 30, 130 can be capable of receiving a parameter from one or more of the auxiliary devices 50 through the various means for providing two-way communication discussed herein. In one example, the means for controlling 30, 130 can be operable to alter operation of the motor 24, 124 based upon the parameter(s) received from the auxiliary device(s) 50. For example, where a water heater 52 requires a particular water flow rate for proper operation, the means for controlling 30, 130 could receive a desired water flow rate parameter from the water heater 52 through the means for providing two-way communication. In response, the means for controlling 30, 130 could alter operation of the motor 24, 124 to provide the requested water performance characteristics.

However, it is to be appreciated that the means for controlling 30, 130 can also be capable of independently controlling the variable speed motor 24, 124 without receipt of a parameter from the auxiliary device(s) 50. That is, the means for controlling 30, 130 could operate in a completely autonomous fashion based upon a predetermined computer program or the like, and/or can receive parameters from operably connected sensor arrangements 34 or the like. In addition or alternatively, the means for controlling 30, 130 can receive parameters from the onboard user interface 31, 131 and can selectively alter operation of the motor 24, 124 based upon the parameters received.

Additionally, where the means for controlling 30, 130 is capable of independent operation, it can also be operable to selectively alter operation of the motor 24, 124 based upon the parameters received from the auxiliary device(s) 50. Thus, the means for controlling 30, 130 can choose whether or not to alter operation of the motor 24, 124 when it receives a parameter from an auxiliary device 50, such as a desired water flow rate from a water heater 52 or a user input parameter from a remote user interface device 66. For example, where the pumping system 10, 110 is performing a particular function, such as a backwash cycle, or is in a lockout state, such as may occur when the system 10, 110 cannot be primed, the means for controlling 30, 130 can choose to ignore a water flow rate request from the heater 52. In addition or alternatively, the means for controlling 30, 130 could choose to delay and/or reschedule altering operation of the motor 24, 124 until a later time (e.g., after the backwash cycle finishes).

Thus, the means for controlling 30, 130 can be configured to control operation of the variable speed motor 24, 124 independently, or in response to parameters received. However, it is to be appreciated that the means for controlling 30, 130 can also be configured to act as a slave device that is controlled by an automation system 70, such as a PLC or the like. In one example, the automation system 70 can receive various parameters from various auxiliary devices 50, and based upon those parameters, can directly control means for controlling 30, 130 to alter operation of the motor 24, 124. It is to be appreciated that the means for controlling 30, 130 can be configured to switch between independent control and slave control. For example, the means for controlling 30, 130 can be configured to switch between the control schemes based upon whether the data cable 90 is connected (e.g., switching to independent control when the data cable 90 is disconnected).

Turning to the issue of operation of the pumping system 10,110 over a course of a long period of time, it is typical that a predetermined volume of water flow is desired. For example, it may be desirable to move a volume of water equal to multiple turnovers within a specified time period (e.g., a day). Within an example in which the water operation includes a filter operation, the desired water movement (e.g., specific number of turnovers within one day) may be related to the necessity to maintain a desired water clarity.

Thus, in accordance with another aspect of the present invention, the means for controlling 30, 130 can be configured to optimize a power consumption of the motor 24, 124 based upon the parameter(s) received from the auxiliary device(s) 50. Focusing on the aspect of minimal energy usage (e.g., optimization of energy consumed over a time period), within some known pool filtering applications, it is common to operate a known pump/filter arrangement for some portion (e.g., eight hours) of a day at effectively a very high speed to accomplish a desired level of pool cleaning. However, with the present invention, the system 10,110 with an associated filter arrangement 22,122 can be operated continuously (e.g., 24 hours a day, or some other time amount(s)) at an ever-changing minimum level to accomplish the desired level of pool cleaning. It is possible to achieve a very significant savings in energy usage with such a use of the present invention as compared to the known pump operation at the high speed. In one example, the cost savings would be in the range of 90% as compared to a known pump/filter arrangement.

Associated with operation of various functions and auxiliary devices 50 is a certain amount of water movement. Energy conservation in the present invention is based upon an appreciation that such other water movement may be considered as part of the overall desired water movement, cycles, turnover, filtering, etc. As such, water movement associated with such other functions and devices can be utilized as part of the overall water movement to achieve desired values within a specified time frame (e.g., turnovers per day). Thus, control of a first operation (e.g., filtering) in response to performance of a second operation (e.g., running a pool cleaner) can allow for minimization of a purely filtering aspect. This permits increased energy efficiency by avoiding unnecessary pump operation.

Accordingly, the means for controlling 30, 130 can determine an optimal energy consumption for the motor 24, 124 over time based upon the parameter(s) received from the auxiliary device(s) 50 and associated first, second, etc. operations. In one example, the motor 24, 124 can be operated at a minimum water flow rate required to maintain adequate water filtration until a higher flow rate is required by a different water operation. In another example, based upon the various water performance characteristics required by each auxiliary device 50, the means for controlling 30, 130 can determine in which order to perform the first, second, etc. operations, or for how long to perform the operations. In addition or alternatively, the means for controlling 30, 130 can optimize operation of the motor 24, 124 based upon actual performance data received from the auxiliary device(s) 50. For example, where a filter arrangement 22, 122 has become clogged over time and requires an ever-increasing water flow or pressure, the means for controlling 30, 130 could choose to simultaneously operate various other auxiliary devices 50 that require high water flow rates (e.g., a heater 52 or the like). Similarly, the means for controlling 30, 130 could choose to delay various operations based upon receipt of actual performance data. For example, where a filter arrangement 22, 122 has become clogged over time and requires an ever-increasing water flow or pressure, the means for controlling 30, 130 could choose to delay operation of an automatic pool cleaner 64 until after the filter arrangement 22, 122 has been cleaned.

It is to be appreciated that the means for controlling (e.g., 30 or 130) may have various forms to accomplish the desired functions. In one example, the means for controlling 30, 130 includes a computer processor that operates a program. In the alternative, the program may be considered to be an algorithm. The program may be in the form of macros. Further, the program may be changeable, and the means for controlling 30, 130 is thus programmable. It is to be appreciated that the programming for the means for controlling 30, 130 may be modified, updated, etc. through the means for providing two-way communication.

Figure 6:
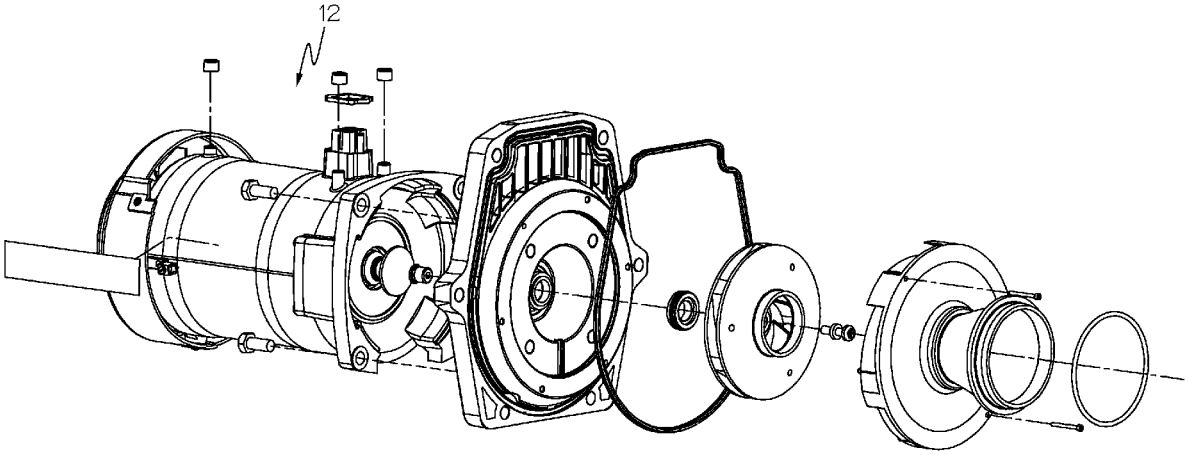
FIG. 6 is a perspective, partially exploded view of a pump of the unit shown in FIG. 5.

Also, it is to be appreciated that the physical appearance of the components of the system (e.g., 10 or 110) may vary. As some examples of the components, attention is directed to FIGS. 5-7. FIG. 5 is a perspective view of the pump unit 12 and the means for controlling 30 for the system 10 shown in FIG. 1. FIG. 6 is an exploded perspective view of some of the components of the pump unit 12. FIG. 7 is a perspective view of the means for controlling 30.

In addition to the foregoing, a method of controlling the pumping system 10, 110 for moving water of a swimming pool is provided. The pumping system 10, 110 includes the water pump 12, 112 for moving water in connection with performance of an operation upon the water and the variable speed motor 24, 124 operatively connected to drive the pump 12, 112. The method comprises the steps of providing means for controlling 30, 130 the variable speed motor 24, 124, providing an auxiliary device 50 operably connected to the means for controlling 30, 130, and providing two-way communication between the means for controlling 30, 130 and the auxiliary device 50. The method also includes the steps of receiving a parameter to the means for controlling 30, 130 from the auxiliary device 50 through the two-way communication, and selectively altering operation of the motor 24, 124 based upon the parameter. In addition or alternatively, the method can include any of the various elements and/or operations discussed previously herein, and/or even additional elements and/or operations.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

What is claimed is:

1. A pumping system for at least one aquatic application, the pumping system receiving information from a user, the pumping system comprising:

a pump;

a motor coupled to the pump;

a control system operating as a master controller, the control system including an automation system, the control system including a remote keypad and display connected to the automation system; and a pump controller located remotely from the control system, the pump controller coupled to at least one of the pump and the motor, the pump controller operating as a slave controller when connected to the control system, the pump controller in digital communication with the motor and the control system, the pump controller transmitting information to and receiving information from the control system over at least one communication link, the pump controller operating the motor to substantially optimize energy consumption based on the information entered into the remote keypad by the user and received from the control system, the pump controller operating independently to control the motor to optimize energy consumption when disconnected from the control system.

2. The pumping system of claim 1, wherein the pumping system performs a number of turnovers of the at least one aquatic application in a predetermined amount of time.

3. The pumping system of claim 1, wherein the at least one communication link includes a cable that is at least one of insulated, shielded, water tight, and includes two wires.

4. The pumping system of claim 1, wherein the at least one communication link includes a wireless link.

5. The pumping system of claim 1, wherein the at least one communication link includes at least one computer network.

6. The pumping system of claim 5, wherein the at least one computer network includes at least one of a local area network, a wide area network, and the Internet.

7. The pumping system of claim 1, wherein the pump controller receives a desired operation of the pumping system from the control system.

8. The pumping system of claim 1, wherein the pump controller transmits an operational status of the pumping system to the control system.

9. The pumping system of claim 1, wherein the pump controller transmits data to the control system and receives data from the control system based on a serial communication specification.

10. The pumping system of claim 9, wherein the serial communication specification includes at least one of RS-232 and RS-485.

11. The pumping system of claim 1, wherein the pump controller transmits problem data for at least one component of the pumping system to the control system.

12. The pumping system of claim 1, wherein the pump controller receives service data for at least one component of the pumping system from the control system.

13. The pumping system of claim 1, wherein the at least one communication link provides at least one of half-duplex and full-duplex communication.

14. The pumping system of claim 1, wherein the information received from the control system includes at least one of flow rate, pressure, motor speed, power consumption, filter loading, chemical levels, water temperature, alarms, operational states, time, energy cost, turnovers per day, and relay or switch positions.

15. The pumping system of claim 1, wherein the pump controller is capable of operating the motor without receipt of information from the control system.

16. The pumping system of claim 1, wherein the pump controller selectively alters operation of the motor based on the information received from the control system.

17. The pumping system of claim 16, wherein the pump controller ignores a request for increased flow rate from the control system during at least one of a backwash cycle and a lock out state.

18. The pumping system of claim 1, wherein the pump controller automatically switches between independent control and slave control depending on whether a data cable is connected to the pump controller.

19. The pumping system of claim 1, wherein the pump controller operates the motor at a minimum flow rate required to maintain adequate filtration until a higher flow rate is required by a different water operation.

20. The pumping system of claim 1, wherein the pump controller optimizes operation of the motor based on actual performance data received from the control system.

21. The pumping system of claim 1, wherein the pump controller delays operation of an automatic pool cleaner until after a filter has been cleaned.

22. The pumping system of claim 1, and further comprising at least one remote auxiliary device in communication with at least one of the control system and the pump controller.

23. The pumping system of claim 22, wherein the at least one remote auxiliary device includes at least one of a water heating device, a chemical dispersion device, and a water dispersion device.

24. The pumping system of claim 22, wherein the at least one remote auxiliary device includes at least one of a filter, a second pump, and a vacuum device.

25. The pumping system of claim 22, wherein the at least one remote auxiliary device includes a user interface to reprogram operating parameters.

26. The pumping system of claim 25, wherein the user interface includes at least one of a remote keypad, and a personal computer.

27. The pumping system of claim 25, wherein the user interface includes a visual display.

28. The pumping system of claim 27, wherein the visual display displays at least one of an operational status of the pumping system and an acknowledgement of commands send to the controller.

29. The pumping system of claim 22, wherein the at least one remote auxiliary device includes at least one of a valve and a switch.

30. The pumping system of claim 22, wherein the at least one remote auxiliary device includes a lighting device for providing illumination to the at least one aquatic application.

31. The pumping system of claim 22, wherein the at least one remote auxiliary device includes at least one of a relay, a sensor, and a timing device.

32. The pumping system of claim 22, wherein the at least one remote auxiliary device includes a communication panel.

33. The pumping system of claim 22, wherein the at least one remote auxiliary device includes a heater, wherein the information received from the control system is that the heater is operating or needs to operate, and wherein the pump controller alters the performance of the pumping system to provide an increased flow rate necessary for proper operation of the heater.

34. The pumping system of claim 22, wherein the pump controller determines which operation of at least two remote auxiliary devices to perform first and for how long to perform each operation.

* * * * *